US009953526B2

(12) United States Patent
Arnold

(10) Patent No.: US 9,953,526 B2
(45) Date of Patent: Apr. 24, 2018

(54) SYSTEM AND ASSOCIATED METHODS FOR OPERATING TRAFFIC SIGNS

(71) Applicant: Charlotte Arnold, Summerville, SC (US)

(72) Inventor: Charlotte Arnold, Summerville, SC (US)

(73) Assignee: Charlotte Kay Arnold, Summerville, SC (US)

( * ) Notice: Subject to any disclaimer, the term of this patent is extended or adjusted under 35 U.S.C. 154(b) by 0 days.

(21) Appl. No.: 15/375,700

(22) Filed: Dec. 12, 2016

(65) Prior Publication Data

US 2017/0169706 A1 Jun. 15, 2017

Related U.S. Application Data

(60) Provisional application No. 62/266,750, filed on Dec. 14, 2015.

(51) Int. Cl.

| | |
|---|---|
| ***G08G 1/07*** | (2006.01) |
| *G08G 1/16* | (2006.01) |
| *G08G 1/0967* | (2006.01) |

(52) U.S. Cl.

CPC ..... *G08G 1/07* (2013.01); *G08G 1/096716* (2013.01); *G08G 1/096783* (2013.01); *G08G 1/164* (2013.01)

(58) Field of Classification Search

CPC ..... G08G 1/07; G08G 1/096783; G08G 1/096716; G08G 1/164

See application file for complete search history.

(56) References Cited

U.S. PATENT DOCUMENTS

| | | | | |
|---|---|---|---|---|
| 3,304,539 A * | 2/1967 | Auer, Jr. | ..... | G08G 1/075 340/920 |
| 3,384,869 A * | 5/1968 | Waldron | ..... | G08G 1/075 340/919 |
| 3,783,446 A * | 1/1974 | McGimpsey | ..... | G08G 1/02 340/917 |
| 4,284,971 A * | 8/1981 | Lowry | ..... | G08G 1/0175 250/222.1 |
| 4,704,610 A * | 11/1987 | Smith | ..... | G08G 1/087 340/906 |
| 4,727,371 A * | 2/1988 | Wulkowicz | ..... | G08G 1/075 340/905 |

(Continued)

*Primary Examiner* — Joseph Feild
*Assistant Examiner* — Rufus Point

(57) ABSTRACT

A system for controlling activation of a traffic warning sign. The system receives a signal generated from a local sensor indicating presence of an automobile and sends an activate signal command in response. The system will activate a local interface logic controller in response to receiving the activate signal command. The system further generates a Wi-Fi connect request with an SSID in response to activating the interface logic controller. The system sends the Wi-Fi connect request to a remote system. The system further determines if the traffic warning sign should be activated and if a positive determination is made, activate the traffic warning sign. Determination is made by determining if a Wi-Fi remote connect request is received. If it is determined a remote connect request has been received, a traffic warning message is generated and sent to a terminal for display or activation.

3 Claims, 4 Drawing Sheets

(56) References Cited

U.S. PATENT DOCUMENTS 4,775,865 A * 10/1988 Smith ..... G08G 1/087 340/906
5,172,113 A * 12/1992 Hamer ..... G08G 1/087 340/902
5,448,219 A * 9/1995 Yoshikawa ..... B60Q 7/00 340/436
5,617,086 A * 4/1997 Klashinsky ..... G08G 1/08 340/436
5,729,214 A * 3/1998 Moore ..... G08G 1/096716 340/525
5,760,686 A * 6/1998 Toman ..... G08B 5/006 340/331
6,204,778 B1 * 3/2001 Bergan ..... G08G 1/075 340/905
6,223,125 B1 * 4/2001 Hall ..... G08G 1/164 701/117
6,243,026 B1 * 6/2001 Jones ..... G08G 1/07 340/906
6,587,778 B2 * 7/2003 Stallard ..... G08G 1/01 340/901
6,897,786 B1 * 5/2005 Kalt ..... G02B 5/128 340/815.4
6,922,136 B2 * 7/2005 Komada ..... G08G 1/164 340/425.5
7,075,427 B1 * 7/2006 Pace ..... B61L 23/06 246/125
7,269,502 B2 * 9/2007 Zhang ..... G08G 1/087 340/907
7,421,334 B2 * 9/2008 Dahlgren ..... G07C 5/008 340/989
7,884,738 B2 * 2/2011 Pappas ..... G08G 1/087 340/815.45
8,374,594 B2 * 2/2013 Yamato ..... G08G 1/096716 455/422.1
8,761,991 B1 * 6/2014 Ferguson ..... G05D 1/0088 340/917
9,251,707 B2 * 2/2016 Kugel ..... G01C 21/3697
9,564,049 B2 * 2/2017 Diba ..... G08G 1/087
9,805,596 B2 * 10/2017 Al-Deek ..... G08G 1/056
2001/0034239 A1 * 10/2001 Yamato ..... G08G 1/096716 455/456.6
2001/0054970 A1 * 12/2001 Jones ..... G08G 1/0955 340/915
2003/0201907 A1 * 10/2003 Thompson ..... G08G 1/07 340/917
2004/0147291 A1 * 7/2004 Zhang ..... G08G 1/087 455/569.2
2004/0263357 A1 * 12/2004 Hamilton ..... G08G 1/01 340/936
2005/0065711 A1 * 3/2005 Dahlgren ..... G07C 5/008 701/117
2005/0141997 A1 * 6/2005 Rast ..... F04D 25/088 416/229 R
2005/0151670 A1 * 7/2005 Johnson ..... G08G 1/07 340/907
2005/0184883 A1 * 8/2005 Graham ..... B61L 29/28 340/917
2005/0286456 A1 * 12/2005 McNew ..... H04W 48/12 370/312
2006/0095199 A1 * 5/2006 Lagassey ..... G07C 5/008 701/117
2006/0181433 A1 * 8/2006 Wolterman ..... G08G 1/08 340/917
2007/0111568 A1 * 5/2007 Ferrari ..... H04L 12/2807 439/131
2007/0115139 A1 * 5/2007 Witte ..... G08G 1/07 340/909
2007/0268685 A1 * 11/2007 Fossier ..... G09F 9/33 362/135
2007/0270120 A1 * 11/2007 Zhang ..... G08G 1/087 455/344
2007/0274233 A1 * 11/2007 Ptashek ..... H04L 67/16 370/254
2008/0018494 A1 * 1/2008 Waite ..... H05B 33/0803 340/907
2008/0074289 A1 * 3/2008 Sauder ..... G08G 1/07 340/909
2009/0174542 A1 * 7/2009 Gentry ..... G08B 7/066 340/500
2010/0026520 A1 * 2/2010 Witte ..... G08G 1/07 340/908
2010/0185411 A1 * 7/2010 Pfeiffer ..... G08G 1/01 702/150
2011/0084176 A1 * 4/2011 Reichelt ..... B61L 23/041 246/473.1
2011/0102202 A1 * 5/2011 Lin ..... G08G 1/0965 340/988
2011/0193722 A1 * 8/2011 Johnson ..... G08G 1/081 340/906
2011/0199231 A1 * 8/2011 Loiselle ..... G09F 9/33 340/907
2011/0304476 A1 * 12/2011 Johnson ..... G08G 1/081 340/906
2012/0206277 A1 * 8/2012 Cai ..... G09F 13/22 340/928
2012/0223843 A1 * 9/2012 Wall ..... G08G 1/095 340/944
2012/0249341 A1 * 10/2012 Brown ..... G08G 1/0104 340/902
2013/0063282 A1 * 3/2013 Baldwin ..... B61L 29/282 340/941
2013/0181849 A1 * 7/2013 Cai ..... G08G 1/09 340/905
2013/0328700 A1 * 12/2013 Ibrahim ..... G08G 1/08 340/907
2014/0032087 A1 * 1/2014 Shiri ..... G06F 17/00 701/117
2014/0062687 A1 * 3/2014 Voticky ..... H04W 4/02 340/438
2014/0118553 A1 * 5/2014 Diba ..... G08G 1/087 348/149
2014/0129121 A1 * 5/2014 Fino ..... G01C 21/34 701/117
2015/0146001 A1 * 5/2015 White ..... H04N 5/23203 348/149
2015/0154860 A1 * 6/2015 Holzwanger ..... G08G 1/005 340/944
2015/0332171 A1 * 11/2015 Nakagawa ..... G06N 99/005 706/14
2015/0334654 A1 * 11/2015 Choi ..... H04W 4/70 370/311
2015/0356871 A1 * 12/2015 Kugel ..... G01C 21/3697 340/935
2016/0200334 A1 * 7/2016 Hilleary ..... G08G 1/097 246/218
2016/0203716 A1 * 7/2016 Jeschke ..... B60W 40/072 701/532
2016/0210855 A1 * 7/2016 Jeschke ..... G08G 1/04
2017/0018179 A1 * 1/2017 Gutierrez ..... H04L 67/12
2017/0061755 A1 * 3/2017 Hou ..... H04W 4/90
2017/0104533 A1 * 4/2017 Oshima ..... H04B 10/116
2017/0196070 A1 * 7/2017 Huang ..... G01J 1/0266
2017/0251541 A1 * 8/2017 Cavalcanti ..... H05B 37/0272

* cited by examiner

200

SYSTEM AND ASSOCIATED METHODS FOR OPERATING TRAFFIC SIGNS

CROSS REFERENCE TO RELATED APPLICATIONS

The present utility patent application claims priority benefit of the U.S. provisional application Ser. No. 62/266,750 filed on Dec. 14, 2015 under 35 U.S.C. 119(e). The contents of this related provisional application are incorporated herein by reference for all purposes.

TECHNICAL FIELD

The present invention relates to the field of traffic warning systems employed to warn vehicles of oncoming traffic conditions and, more particularly, to system process methods used in traffic warning systems to alert drivers about merging traffic.

BACKGROUND

Rear-end collisions on our highways are a major cause of serious injury. The incidence of rear-ends collisions has risen rapidly as our highway systems get increasingly congested. Drivers have been admonished and given a variety of guidelines for following distance; however, these have done little to alter driving habits. Drivers on the highway are often jockeying for position, and some feel that when attempting to follow at a "safe distance", the space just quickly fills with one or more vehicles. Unfortunately, when vehicles closely follow one another there is often insufficient time for a driver to respond to a situation and come to a stop prior to rear-ending the vehicle ahead. In existing vehicles, drivers are unable to gain sufficient information relating to the action of drivers and conditions farther up the road. Drivers may watch brake lights come on and go off again as they try to see what is occurring farther up the road. Often the view up ahead is obscured, or completely blocked, by the vehicle ahead, leaving the driver reliant on being extremely alert and having fast reaction times. Unfortunately, drivers are also relying on luck which can run out at any time when the person ahead unexpected "slams" on the brakes. Under actual driving conditions, by the time a driver recognizes a "situation" they often have insufficient time to slow, or stop, in order to prevent colliding with another vehicle. Coming to a stop from highway speeds can require 3-4 seconds during which over 200 hundred feet of highway may be traversed. At highway speeds, every $\{\text{fraction } (1/100)\}^{th}$ of a second that a driver delays in applying their brakes can translate to another foot of highway. The energy for these additional feet is often absorbed by the rear end of another vehicle. In many cases significant injuries may be prevented by decreasing reaction times by a few hundred milliseconds.

Numerous concepts have been considered for reducing rear-ends collisions. The thought of computer controlled automobiles have been around since the advent of microcomputers. Various prior arts have disclosed traffic merging warning systems. U.S. Pat. No. 8,068,036 B2 discloses a system that alerts the operator of a vehicle, when the operator is not in compliance with an intersection signal condition; i.e., the system intelligently determines if a vehicle is traveling at a speed that would make the vehicle in non-compliance with the intersection signal condition and notifies the driver of such non-compliance. U.S. Pat. No. 6,223,125 B1 discloses a collision avoidance system to prevent collisions by monitoring intersection traffic and intelligently controlling traffic lane perturbations to prevent intersection collisions. U.S. Pat. No. 7,990,286 B2 discloses a vehicle positioning system that receives location codes from passive tags positioned along a road system and reports these location codes to a central traffic management service. US Patent Application No. 20050040970 A1 discloses a one way information system for detecting environmental traffic conditions and notifying drivers of said conditions.

What is needed is a system, device and method for alerting drivers of oncoming and merging traffic in more efficient and effective ways. As will be seen from the subsequent description, the preferred embodiments of the present invention overcome shortcomings of the prior art.

SUMMARY

Techniques herein provide computer-implemented methods to control activation of traffic warning signs. A system, e.g. that is part of a computer operating system, for controlling the activation of a traffic warning sign employs a local logical component, i.e. a modified user space application, that receives a signal generated from a local sensor wherein the signal indicates presence of an automobile and, in response, the local logical component generates and sends an activate signal command. The system further employs the use of another local logical component that activates a local interface logic controller in response to receiving the activate signal command. The interface logic controller generates a Wi-Fi connect request with an SSID in response to activation and sends the Wi-Fi connect request to a remote system. The interface logic controller further determines if a Wi-Fi remote connect request is received, e.g. determines if connect request has been previously received or subsequently received within a specified period of time. If a positive determination is not made, the interface logic controller may terminate. Alternatively, if a positive determination is made, a traffic warning message may be generated and sent to a display terminal, causing the terminal to activate is some manner.

In certain example aspects described herein, systems and computer program products are utilized to to control activation of a traffic warning signs.

These and other aspects, objects, features and advantages of the example embodiments will become apparent to those having ordinary skill in the art upon consideration of the following detailed description of illustrated example embodiments.

DETAILED DESCRIPTION OF THE EXAMPLE EMBODIMENTS

The object of the described invention is to describe a client and server application systems that efficiently and effectively detect the presence of vehicles traveling in the direction of merging traffic and provide information to warn drivers of the oncoming traffic. A motivation for providing such a system is to alert drivers of potential dangers that lie ahead and possible prevent collisions and personal harm to drivers and passengers. A further motivation is to provide these early warning systems in a manner that is cost effective to produce and use but also reliable.

In an example embodiment, the client and server application systems each include a sensor interface controller for receiving information indicating detection of an automobile, a wireless interface controller for sending connection request commands and further processing in response to receiving connection request commands, a messaging notification controller for generating messages and causing the messages to be displayed in response to receiving a connection request command, and a systemd activation controller for controlling activation of the sensor interface controller and wireless interface controller in response to receiving a sensor signal indicating automobile presence. In a practical example, an automobile may approach an on-ramp, e.g. coming from underground parking of an office building, and the sensor interface controller will detect such presence. In response to detection, the systemd activation controller will activate the sensor interface controller upon receiving a signal indicating automobile presence and the wireless interface controller causing the interface controller to send a connection request to a remote system. The wireless interface controller will then determine if any pending connection requests have been received from the remote system. If no connection requests are pending or not requests have been received within a predetermined time period, the interface controller performs no further operations. However, if there are pending requests or requests have been received within the time period, a warning message is generated and caused to be displayed.

Example System Architectures

Turning now to the drawings, in which like numerals represent like (but not necessarily identical) elements throughout the figures, example embodiments are described in detail.

Figure 1:
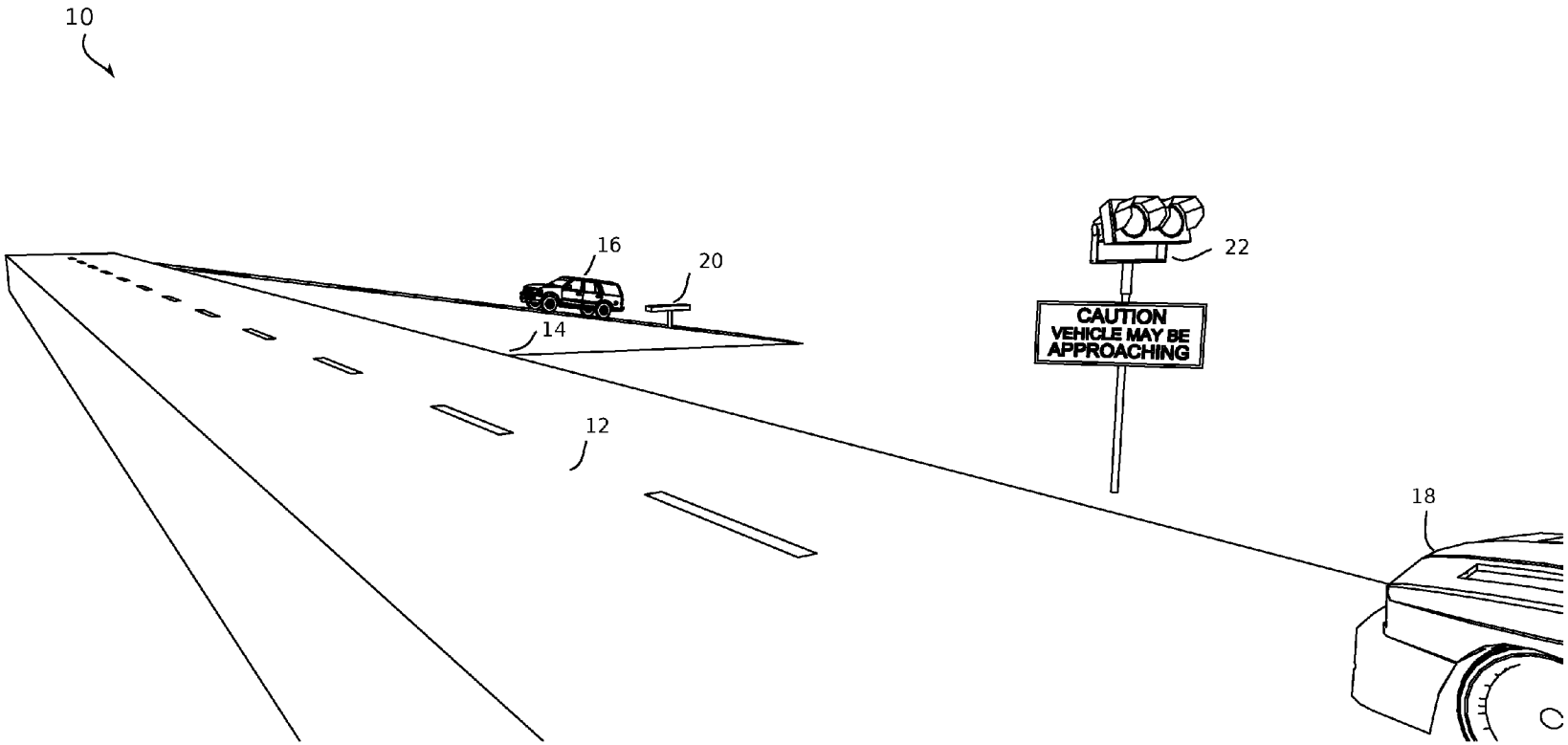
FIG. 1 is an illustration of a use of a bi-directional detection and communications system for warning drivers of merging traffic, in accordance with certain example embodiments.

FIG. 1 is an illustration of an application of a detection and communication system for warning drivers of merging traffic and is denoted generally as 10. The application 10 includes road way 12, an on-ramp 14, a first vehicle merging from the on-ramp 14 onto the road way 12, a second vehicle 18 traveling on the road way 12, a first sensor detection and communication system 20, and a second, sensor detection and communication system 22. However, it should be understood the system 20,22 may include only one detection system for only one of the systems. That is to say, an embodiment may be that only one system detects automobiles and communicates an indication of such to the other system so that the other system can warn other drivers. The systems 20,22 operate in a manner to efficiently and effectively provide drivers an early warning of oncoming traffic. In a first example embodiment, system 20 detects the presence of an oncoming vehicle 16 and sends a connection request to system 22. System 22, in response, automatically generates a warning message and causes the message to be displayed. In a second embodiment, system 20,22 each detect oncoming vehicle 16,18 and, in response, send a connection request. System 20,22 will receive the connection request and generate a warning message and cause the warning message to be displayed or otherwise cause indications, such as warning lights, to be activated. In this embodiment, if only one of the systems receive indication of the presence of a vehicle, no messages or signal indications will be caused to be displayed.

Figure 2:
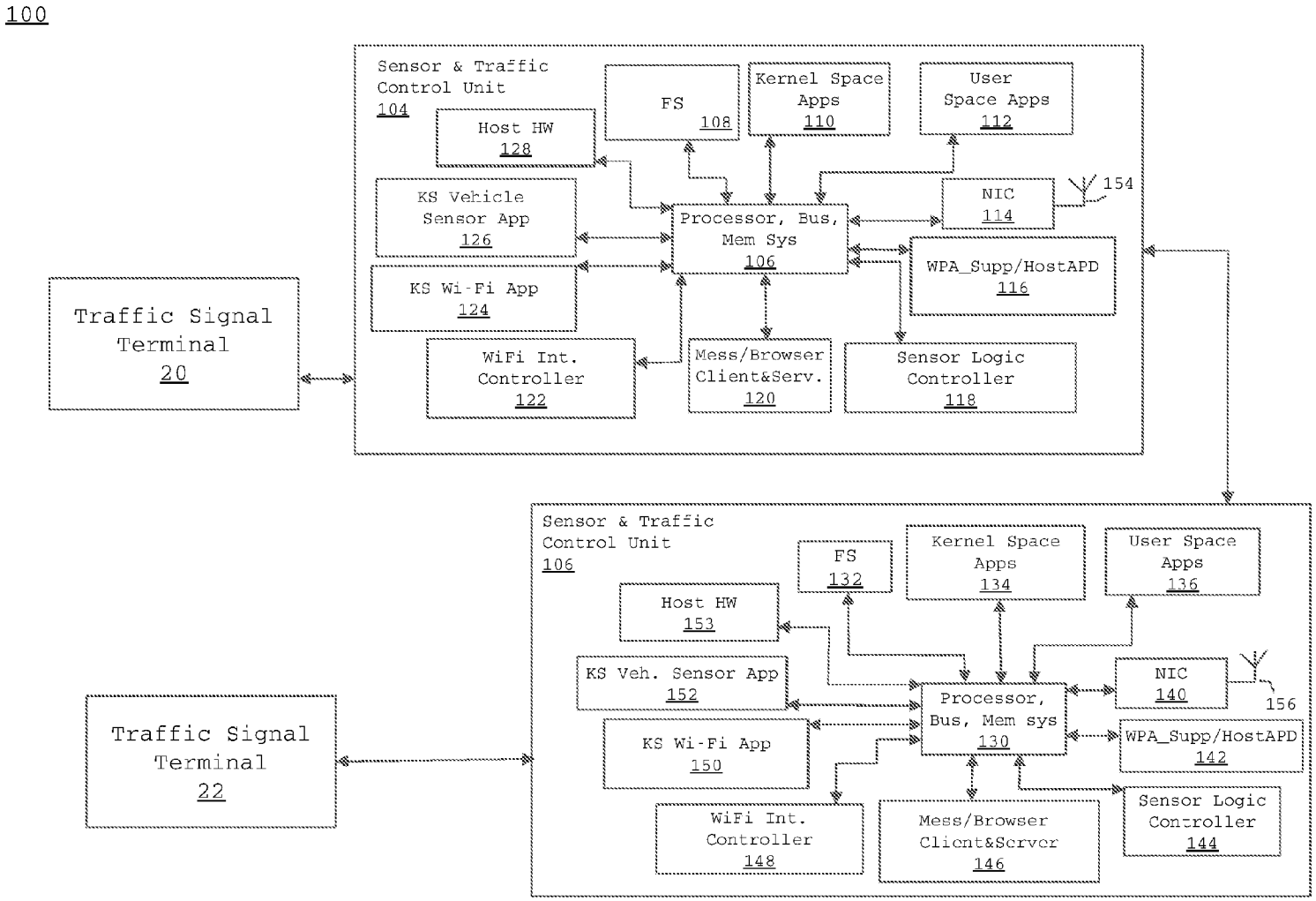
FIG. 2 is an illustration of a system architecture depicting the bi-directional detection and communications system for warning drivers of merging traffic, in accordance with certain example embodiments.

FIG. 2 is an illustration of system architecture depicting a system to detect the presence of an automobile and provide notification in response thereto and is denoted generally 100. The system architecture 100 includes traffic signal terminal 20 and traffic signal terminal 22 communicable coupled with sensor and traffic control unit 104,106, respectively, and the control unit 104,16 each communicable coupled together. Sensor and traffic control unit 104 may include a processor, system bus and memory system 106, a file system 108, kernel space applications or modules 110, user space applications 112, a Network Interface Card 114, a WPA_supplicant and hostAPD (Application Protocol Daemon) unit 116, a sensor logic controller 118, a message server 120, a Wi-Fi interface controller 122, a kernel space Wi-Fi module 124, kernel space vehicle sensor module 126, and other host system hardware resources 128, such a video card, serial port cards, and a vehicle sensor, such as radar or camera hardware. Sensor and traffic control unit 106 may include a processor, system bus and memory system 130, a file system 132, kernel space applications or modules 134, user space applications 136, a Network Interface Card 138, a WPA_supplicant and hostAPD (Application Protocol Daemon) unit 140, a sensor logic controller 142, a message server 144, a Wi-Fi interface controller 146, a kernel space Wi-Fi module 148, kernel space vehicle sensor module 150, and other host system hardware resources 153, such a video card, serial port cards, and a vehicle sensor, such as radar or camera hardware. In addition, control unit 104,140 may be fitted with directional antenna 154,156 to improve the distance of the Wi-Fi transmissions.

In a first example use of the system architecture 100, sensor logic controller 118 may be registered with host services of the control unit 104. In other words, logic controller 118 may receive notification from vehicle sensor application 126 when the sensor detects the presence of a vehicle in proximity to the sensor. The sensor hardware may be a pressure switch, a radar unit, imaging unit, or other signal transmitting and receiving unit that can detect the presence of a vehicle. Upon receiving the notification, the sensor logic controller 118 notifies the WiFi interface controller 122. Interface controller 122 activates the WPA supplicant 116 and causes a connect request or session establishment request to be generated with appropriate source and destination local IP address information and a Service Set Identifier (SSID). The request is sent to the control unit 106 and the WPA_supplicant 116 may be disabled upon acknowledgement of receipt. In the control unit 106, the HostAPD 142 receives the connect request and reports the attempt to the Wi-Fi interface controller 148. The controller 148, in response, causes the messaging server, e.g. Apache web server, to retrieve a pre-stored message, e.g. from the FS 132 that indicates merging traffic, and cause the message to be displayed on signal terminal 22, or otherwise causes lights to flash.

In a second example, vehicle sensor application or module 126 may receive indication of vehicle presence in proximity and notify logic controller 118. Logic controller 118, in response, may notify Wi-Fi interface controller 122. In this case, interface controller 122 generates a connect request and sends the connect request to control unit 106.

interface controller 122 further determines if a connect request has been received from control unit 106. If it is determined no connect request has been received, the interface controller 122 may place itself in a wait state for a pre-determined amount of time in order to wait for a received connect request. If no connect request exists or if no connect request is received within the pre-determined amount of time, the interface controller may terminate further processing. If a connect request has been received or is received within the amount of time, the interface controller 104, in response, causes the messaging server 120, e.g. Apache web server, to retrieve a pre-stored message, e.g. from the FS 108 that indicates merging traffic, and cause the message to be displayed on signal terminal 20. In a same functional way, control unit 106 operates in the same manner. That is to say, that each system can generate and receive Wi-Fi connection requests, but only causes traffic warning sign activation if a local sensor indicating presence of an automobile activates the controller. A purpose of the system is to provide a system units that are easy to manage, configure, and use with minimal cost and that utilize minimal resources. This type of system would be useful in cases where power supply and is minimal and, as such, efficient use of resources is required.

In order to further improve efficiency, control unit 104, 106 may operate using minimal user application space resources. For example, the use of Arch Linux® in this case would be an idea operating system and only essential kernel resources would be always active. Other applications would only be active when needed. For example, Linux® user space application systemd may be used in conjunction with a modified network manager. The modified network manager receives kernel space Wi-Fi application and kernel space vehicle sensor application signals and, in response, may active the WPA_supplicant application, the HostApd application, the Wi-Fi interface controller 122, and sensor logic controller 118 as needed. For example, the network manager may receive a connection request from a remote Wi-Fi system controller over a specified port and in response cause HostApd to be activated so that the request can be processed and stored for a predetermined period of time. Furthermore, a cron scheduler may be used to activate the modified network manager at predesignated times, further improving processing efficiencies.

Figure 3:
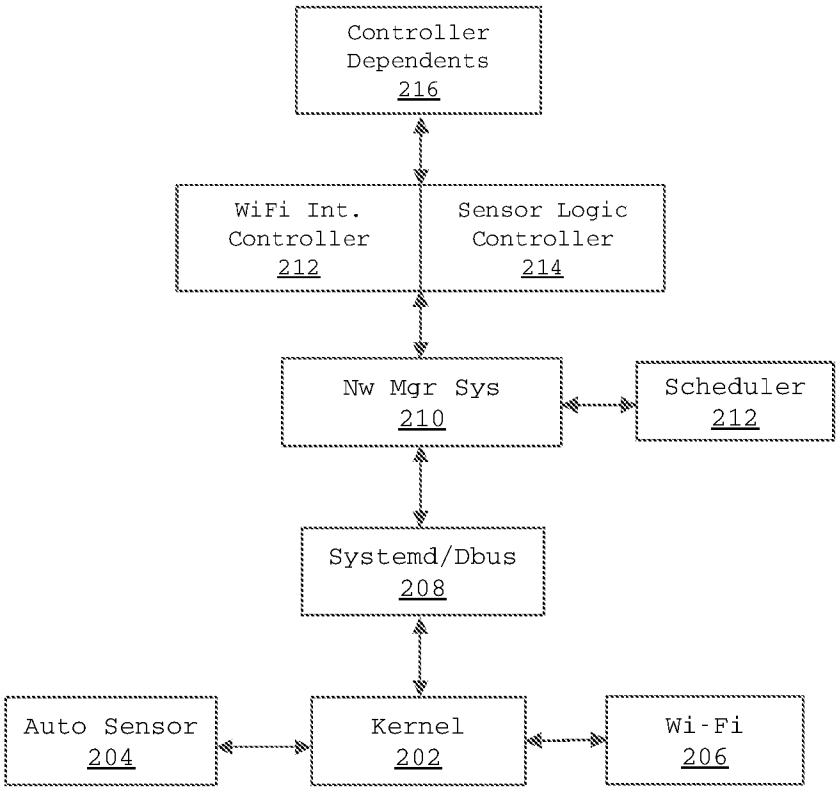
FIG. 3 is an illustration of a system software stack depicting certain process components of the bi-directional detection and communications system for warning drivers of merging traffic, in accordance with certain example embodiments.

Referring to FIG. 3, illustrated is a modified Linux® software stack adapted to operate according to specific requirements of the system and is denoted generally 200. The requirements mentioned include that select user space applications are operated to provide indications of merging traffic only when needed and, optionally, only at scheduled times.

The stack 200 includes kernel space applications that comprise of a kernel module 202, e.g. from Arch Linux®, that would further include an automobile sensor module 204, and a Wi-Fi driver module 206. The user space applications may comprise a systemd application and dbus application 208. The systemd application and dbus application function to pass communications between kernel modules and user space applications. The stack further includes user space applications that comprise a network manager system 210, a scheduler 212, e.g. cron scheduler, a sensor logic controller 214, a Wi-Fi interface controller 202, and controller dependents 216. The stack 200 functions so that Wi-Fi module 206 and auto sensor module 204 are always on and can transmit and receive necessary communication signals and messages and cause kernel 202 to communicate the signals and messages to systemd 208. This in result causes the dbus component 208 to notify the network system manager 210 of the activity. However, it should be understood that scheduler 212 may dictate when network manager system is actually activated 210. If the network manager system 210 is on, whether always on or at scheduled times, the network manager receives the messages from kernel 208 and activates Wi-Fi interface controller 212 and sensor logic controller 214, or alternatively the sensor logic controller 214 activates the Wi-Fi interface controller in response to activation, which in response activates controller dependents 216. In this manner, the stack 200 is designed to functionally operate in a controlled and efficient manner so that resource consumption is minimized while still providing the necessary functionality needed. It should be understood that systemd, dbus, and network manager system are common software tools used in communications and processing technology that anyone of ordinary skill in the art would recognize.

Example Processes

Figure 4:
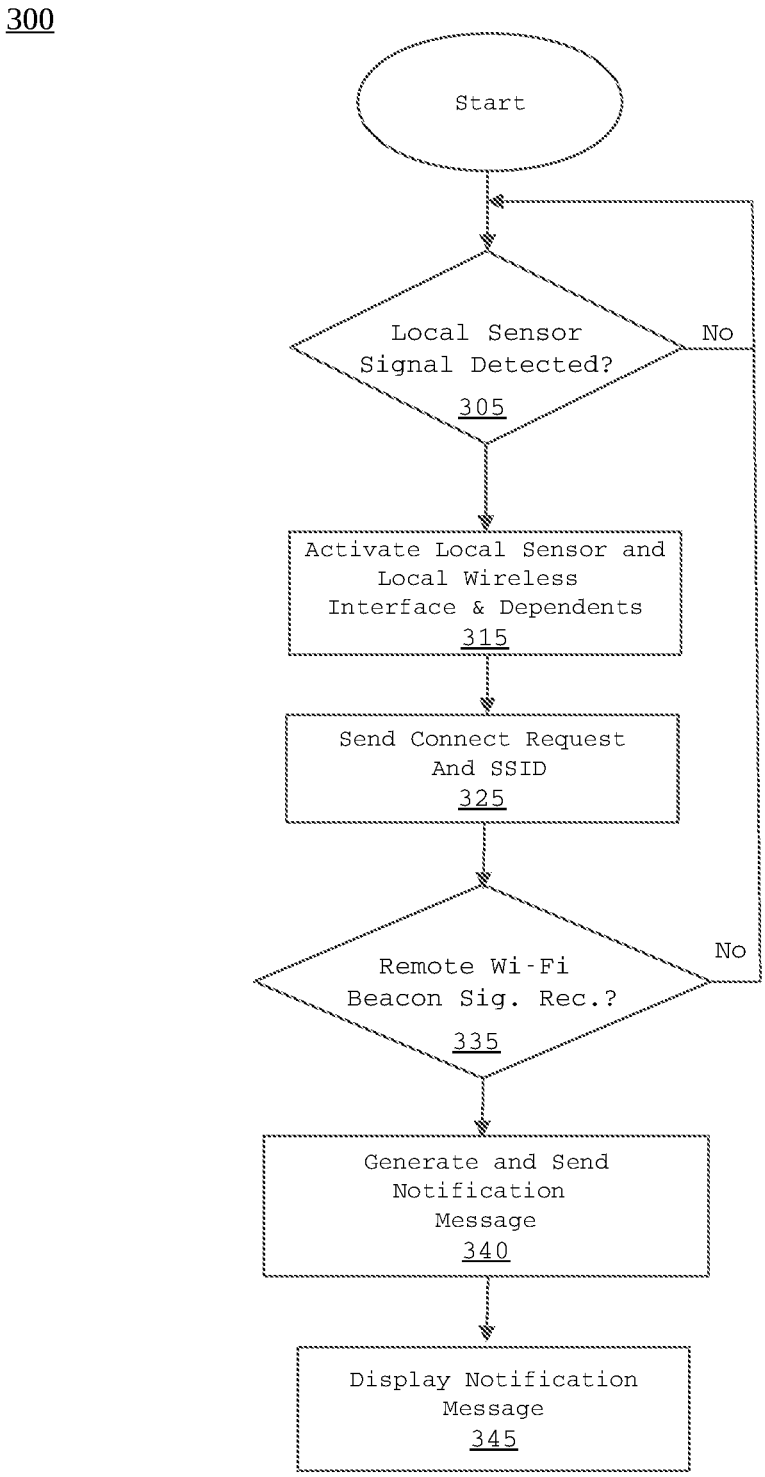
FIG. 4 is an illustration of a process flow diagram for detecting the presence of a vehicle and sending warning messages to a remote terminal.

The example method illustrated in FIG. 4 is described hereinafter with respect to the components of the example operating environment 100. The example methods of FIG. 2 may also be performed with other systems and in other environments.

Referring now to FIG. 4, illustrated is an example process flow diagram for detecting automobiles and providing notification messages to or activating traffic control signs or signals that is implemented in example embodiments pursuant to the illustrated architectures of FIGS. 2 and 3 and is denoted generally as 300. Process flow diagram 300 begins, e.g. upon the system powering up, and upon such beginnings the process flow determines whether the automobile sensor has detected the presence of a vehicle, step 305. If not, the process returns to the beginning. If a vehicle has been detected, the local auto sensor logic controller and wireless interface controller and associated dependents are activated, at step 315. Further processing requires, at step 325, that a send connect request with an SSID be generated and sent to the opposing controller unit. In a first embodiment, the process at this point will determine if a remote Wi-Fi beacon signal, i.e. a connect request signal, has been received from a remote unit. If not, the process will wait for a predetermined time for a connect request signal. If a signal is received, a notification message will be generated, step 340, and caused to be displayed on a messaging terminal, step 345. In one embodiment, both previously described systems use the method processes just described. In an another embodiment, one of the systems will use steps 305-325 and another system will use steps 335-345. In the latter case, necessary system components to receive connect requests will always be activated.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

The invention claimed is:

1. A system for controlling activation of a traffic warning sign, comprising:

a storage resource;

a processor communicatively coupled to the storage resource, wherein the processor executes application code instruction that are stored in the storage resource to cause the system to:

receive a signal generated from a local sensor indicating presence of an automobile and send an activate signal command in response;

activate a local interface logic controller in response to receiving the activate signal command;

generate a Wi-Fi connect request with an SSID in response to activating the interface logic controller;

send the Wi-Fi connect request to a remote system;

determine if the Wi-Fi remote connect request is received;

terminate the process upon determining the connect request is not received;

generate a traffic warning message if a positive determination of the remote connect request is received; and send the traffic warning message to the traffic warning sign, causing the message to be displayed.

2. A computer program product, comprising:

a non-transitory computer-readable storage device having computer-executable program instructions embodied thereon that when executed by a computer cause the computer to control activation of a traffic warning sign, the computer-executable program instructions comprising:

computer-executable program instruction to interface with a data storage resource application and receive a signal generated from a local sensor indicating presence of an automobile and send an activate signal command in response;

computer-executable program instructions to activate a local interface logic controller in response to receiving the activate signal command;

computer-executable program instruction to generate a Wi-Fi connect request with an SSID in response to activating the interface logic controller;

computer-executable program instruction to send the Wi-Fi connect request to a remote system;

computer-executable program instructions to determine if the Wi-Fi remote connect request is received;

computer-executable program instructions to terminate the process upon determining the connect request is not received;

computer-executable program instructions to generate a traffic warning message if a positive determination of the remote connect request is received; and computer-executable program instructions to send the traffic warning message to the traffic warning sign a terminal, causing the message to be displayed.

3. A computer-aided method for controlling activation of a traffic warning sign, the method comprising:

receiving a signal generated from a local sensor indicating presence of an automobile and send an activate signal command in response;

activating a local interface logic controller in response to receiving the activate signal command;

generating a Wi-Fi connect request with an SSID in response to activating the interface logic controller;

sending the Wi-Fi connect request to a remote system; and determine if a Wi-Fi remote connect request is received;

terminating the process upon determining the connect request is not received;

generating a traffic warning message if a positive determination of the remote connect request is received; and sending the traffic warning message to the traffic warning sign, causing the message to be displayed.

* * * * *